United States Patent [19]

Honkanen

[11] 4,329,791

[45] May 18, 1982

[54] PLOW CADDY

[76] Inventor: Jerry P. Honkanen, 2907 Lake Forest Rd., Tahoe City, Calif. 95730

[21] Appl. No.: 153,587

[22] Filed: May 27, 1980

[51] Int. Cl.[3] ..... E02F 3/76; B66F 3/46

[52] U.S. Cl. ..... 37/42 R; 254/8 B; 254/124

[58] Field of Search ..... 37/41 R, 42 R, 50; 254/8 R, 8 B, 8 C, 124

[56] References Cited

U.S. PATENT DOCUMENTS

| | | | |
|---|---|---|---|
| 1,280,472 | 10/1918 | Hopkins | 254/8 B |
| 3,059,785 | 10/1962 | Buckeye | 254/124 |
| 4,190,233 | 2/1980 | Godfrey | 254/8 B X |

FOREIGN PATENT DOCUMENTS

| | | | |
|---|---|---|---|
| 132594 | 5/1949 | Australia | 254/8 B |

*Primary Examiner*—E. H. Eickholt
*Attorney, Agent, or Firm*—Robert Charles Hill

[57] ABSTRACT

A plow caddy for facilitating attachment of a plow, such as a snowplow, having a blade and a connecting frame provided with a rear connecting portion to a vehicle having an elevated attachment portion. The caddy includes a wheeled support having front and rear portions. In the illustrated embodiment, a channel is provided on the front portion for removably receiving the lower edge of the plow blade for supporting the plow blade during positioning movement of the caddy. A manually operable adjusting device is provided on the support for adjustably elevating a rear supporting element on the wheeled support for correspondingly elevating the rear connecting portion of the plow frame to align it with the vehicle attachment portion. The adjusting device includes a handle which is manipulatable at the front of the caddy for facilitating the controlled elevation of the plow frame rear portion. A brake is provided for locking the caddy against movement when desired, and in the illustrated embodiment, includes an operating handle mounted to a manipulating handle on the front portion of the caddy for facilitating wheeled movement thereof.

2 Claims, 6 Drawing Figures

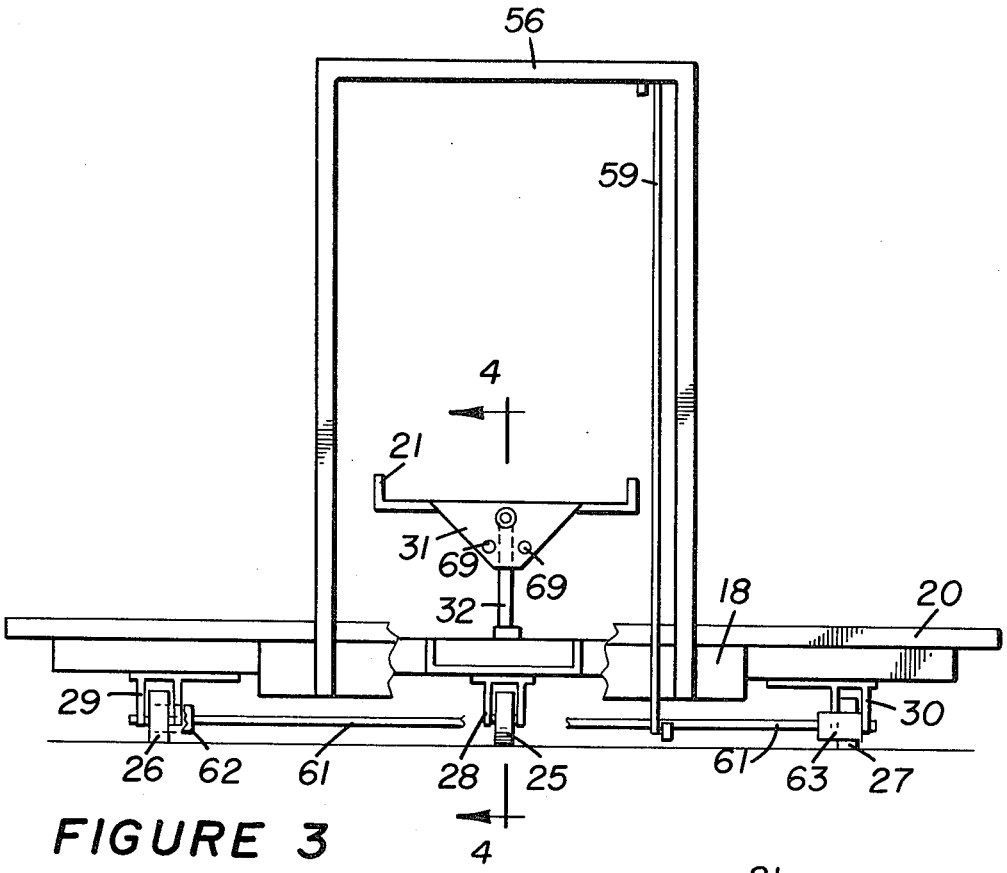
FIGURE 3
FIGURE 4
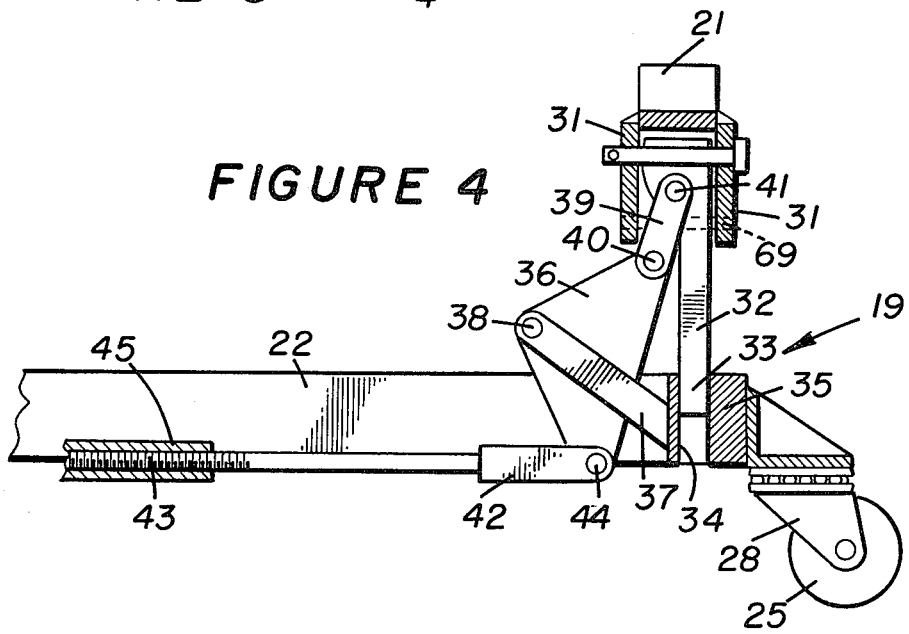

PLOW CADDY

BACKGROUND OF THE INVENTION

1. Field of the Invention

This invention relates to the attachment of plows and the like to vehicles, such as trucks and the like.

2. Description of the Prior Art

It is conventional to mount snowplows and the like to the front of a drive vehicle, such as a truck, by connecting a rear frame portion of the plow to an attachment portion on the truck. The attachment portion is conventionally elevated and it is necessary to utilize substantial forces in making the connection of the frame to the attachment. Because of the inherent difficulty in making such attachment, a number of workers are normally required to effect the attachment.

A number of devices have been developed in the background art for positioning of elements relative to a vehicle. Illustratively, in U.S. Pat. No. 2,637,449 of Clarence F. Hamer, a transmission jack is shown for installing and removing heavy parts from the underside of automobiles, trucks, tractors, etc. The jack is arranged to be rolled under the portion of the vehicle which it is desired to remove. The jack is then elevated by manipulation of a handwheel so as to adjust the position of a table which, after the part is disconnected from the vehicle, is lowered, permitting the jack to be rolled from under the vehicle with the part carried thereon.

An extensible and foldable hand truck is shown in U.S. Pat. No. 2,716,557 of Charles L. Gould et al to include a wheeled frame having an upstanding front handle portion. The load is placed directly on the platform and illustratively comprises boxes placed thereon in stacked relation so as to be engaged against the handle structure. The hand truck is arranged to be tilted backwardly to elevate the front caster wheel over obstructions which may be encountered during the movement thereof.

Noral A. Nelson shows, in U.S. Pat. No. 2,826,430, a tractor-implement coupling mechanism which may be engaged or disengaged by maneuvering the tractor relative to the implement and utilizing a power actuated rear hitch under the control of the operator on the tractor. The coupling mechanism is engaged upon powered elevation of the rear hitch mechanism for the tractor to eliminate the need for rear jack means on the implement frame. The patentee further describes a copending application structure wherein the implement frame is supported by front and rear retractable jack elements, permitting the tractor to be backed up so that a coupling element at its rear portion underlies a cooperating coupling element on the jack frame. After arranging the tractor in this manner, the operator gets off the tractor and lowers the rear jack stand until the coupling element is engaged. After making the connection, the front jack stand is also retracted to permit the implement to be connected for propulsion.

In U.S. Pat. No. 3,159,917, Stewart E. Whitehead shows a visual aid for a trailer hitch which may be removably mounted on a vehicle and on a trailer to indicate to the driver of the vehicle when the interlocking portions of the trailer hitch on the vehicle and trailer are in vertical alignment.

SUMMARY OF THE INVENTION

The present invention comprehends an improved apparatus for facilitating attachment of an implement, such as a plow, to a vehicle, such as a truck. In the illustrated embodiment, the plow includes a blade and a connecting frame provided with a rear connecting portion adapted to be connected to an elevated attachment portion of the vehicle. The apparatus includes a wheeled support having front and rear portions.

Carrying means may be provided on the wheeled support front portion for removably carrying the lower edge of the plow blade.

Adjustable means are provided on the support for adjustably elevating the rear connecting portion of the plow frame to align the connecting portion with the vehicle attachment portion.

In the illustrated embodiment, the blade carrying structure comprises an upwardly opening channel mounted to the frame and capable of a pivoting movement.

The adjustable means, in the illustrated embodiment, includes an upwardly opening channel on the wheeled support rear portion. The adjustable means further includes, in the illustrated embodiment, manually operable means including a manipulating handle at the front portion of the wheeled support.

The wheeled support may include a positioning handle for positioning the wheeled support with the plow carried thereon so as to dispose the connecting portion adjacent the vehicle attachment portion.

Locking means are provided for selectively locking the wheeled support against rolling movement when desired. The locking means include a manipulating handle adjacent the positioning handle, and in the illustrated embodiment, means are provided for movably mounting the locking means handle to the positioning handle.

The manipulating handle of the adjusting means is disposed at the front portion of the wheeled support and in the illustrated embodiment, is disposed subjacent the positioning handle thereon.

Thus, the improved implement caddy of the present invention permits facilitated placement of the plow thereon, facilitated movement of the carried plow into connecting disposition relative to the vehicle attachment portion, and facilitated adjustment of the connecting portion of the plow relative to the attachment portion of the vehicle. The caddy is arranged to permit control of the different operations from the front portion thereof. Further, the caddy is arranged to permit such facilitated connection of the plow as a one-person operation.

The caddy of the present invention is extremely simple and economical of construction while yet providing the highly desirable features discussed above.

BRIEF DESCRIPTION OF THE DRAWING

Other features and advantages of the invention will be apparent from the following description taken in connection with the accompanying drawing wherein:

FIG. 3 is a front elevation of the caddy;

FIG. 4 is a fragmentary enlarged vertical section taken substantially along the line 4—4 of FIG. 3;

DESCRIPTION OF THE PREFERRED EMBODIMENT

Figure 1:
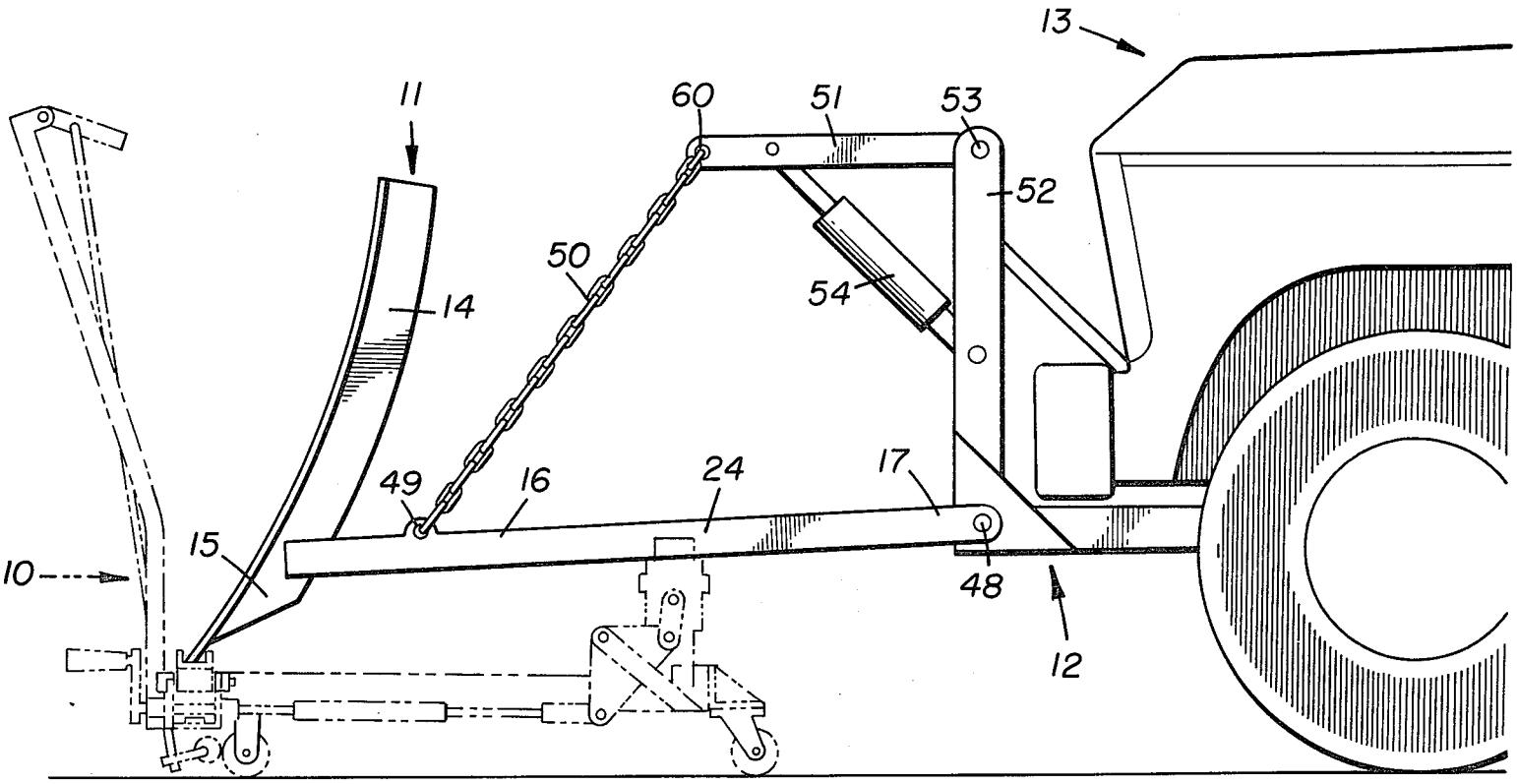
FIG. 1 is a fragmentary side elevation of a plow attached to a truck attachment means as by use of a caddy embodying the invention.

In the exemplary embodiment of the invention as disclosed in the drawing, an apparatus generally designated 10 is shown to comprise a caddy for use in positioning an implement, such as a plow, 11 relative to the attachment means generally designated 12 of a vehicle, such as a truck, 13.

As illustrated in FIG. 1, the plow 11 includes a plow blade 14 having a lower edge portion 15 and a rearwardly extending frame 16 defining a rear connecting portion 17.

Figure 2:
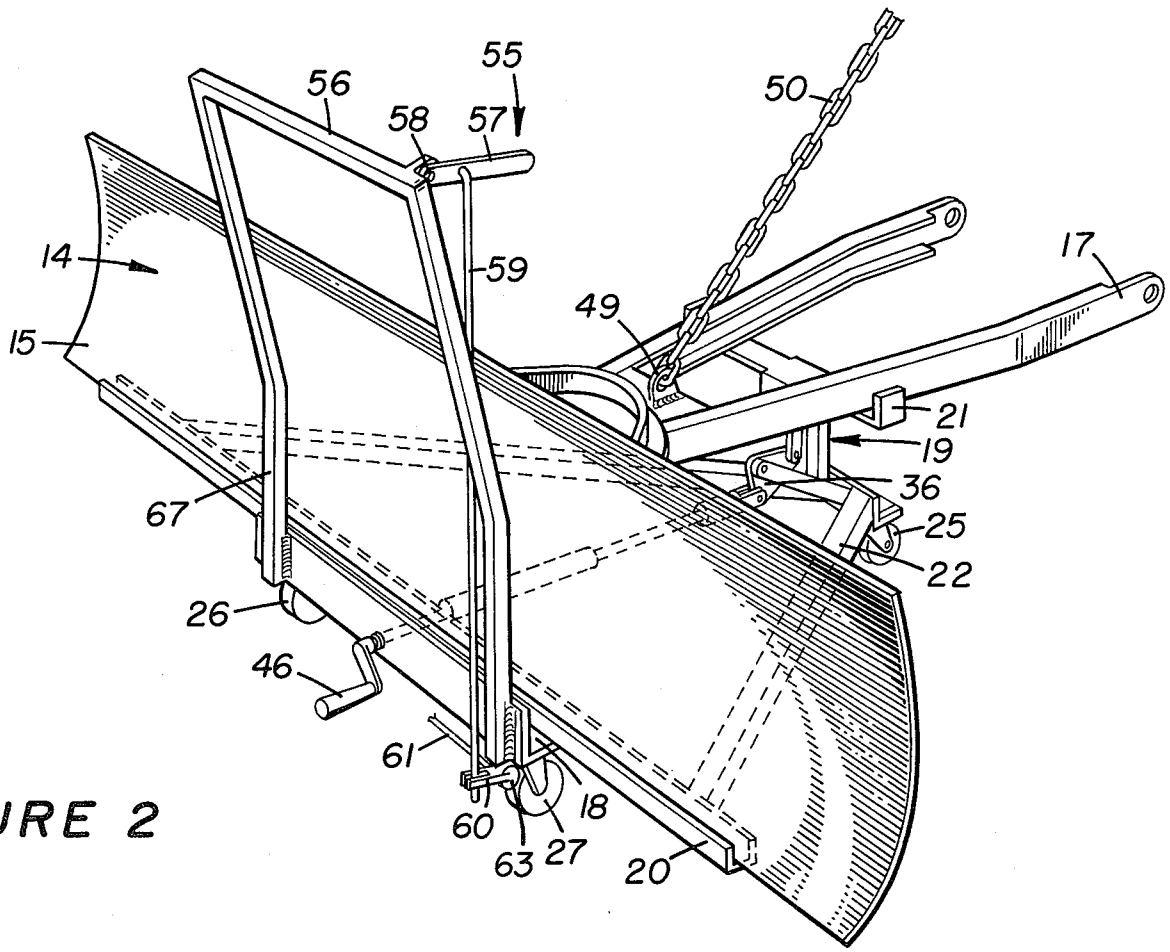
FIG. 2 is a perspective view illustrating the mounting of the plow on the caddy for movement thereof relative to the vehicle.

As illustrated in FIG. 2, caddy 10 comprises a wheeled support having a front portion 18, a rear portion 19, a blade-carrying means 20 on the front portion 18, and a frame carrying portion 21 on the rear portion 19.

Figure 5:
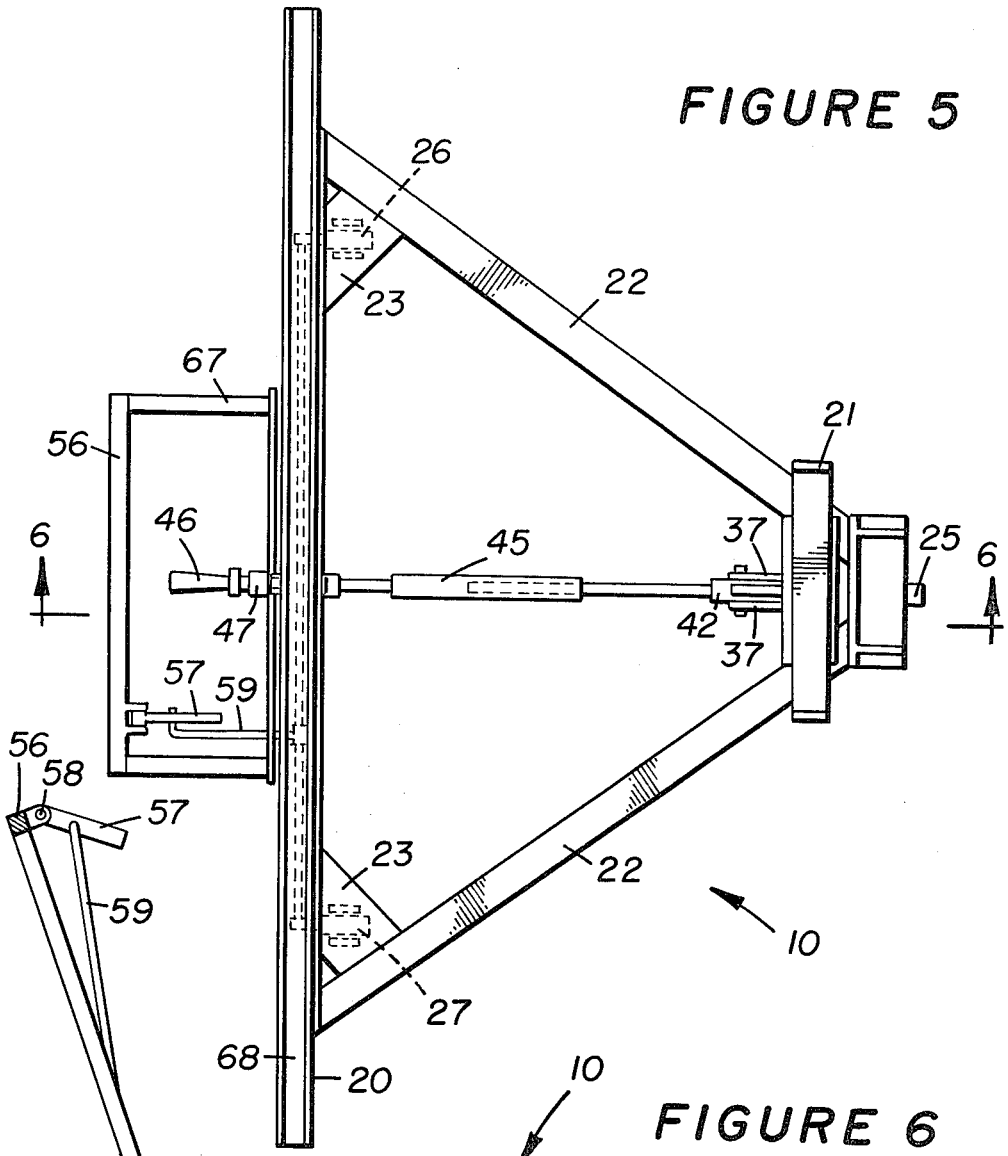
FIG. 5 is a top plan view of the caddy.

As best seen in FIG. 5, the wheeled support defines a triangular frame 22 provided with reinforcing gussets 23 at the corners thereof. The blade-carrying means defines an upwardly opening channel carried on the front portion 18 of the triangular frame 22. As illustrated in FIGS. 1 and 2, the lower edge 15 of blade 14 is adapted to be received in the upwardly opening channel for facilitated carrying of the blade on the wheeled support with frame 16 extending rearwardly so as to have a middle rear portion 24 of the frame rest in the frame carrying means 21 defining an upwardly opening channel element.

As shown in FIG. 3, the caddy is provided with a rear wheel 25 on the rear portion 19 thereof and a pair of front wheels 26 and 27 on the front portion 18 thereof. Wheel 25 is supported on a suitable caster 28 and wheels 26 and 27 are supported on fixed mounting brackets 29 and 30, respectively.

Frame support 21 having a suitable pivoting limit means associated therewith, as for example, limit pins 69, is carried by a bracket 31 mounted to a vertical slide 32 having its lower end 33 slidably received in a guide channel 34 of a guide portion 35 on the caddy rear portion 19, as shown in FIG. 4. Slide 32 is positioned vertically in the guide channel 34 by a crank 36 pivotally mounted to a support bracket 37 on caddy portion 19 by a pivot 38. The crank is connected to the slide 32 by a link 39 which is connected to the crank 36 by a pivot 40 and to the slide 32 by a pivot 41. The crank is further pivotally connected to a connecting portion 42 of a jack screw 43 by a pivot 44, as further shown in FIG. 4.

Figure 6:
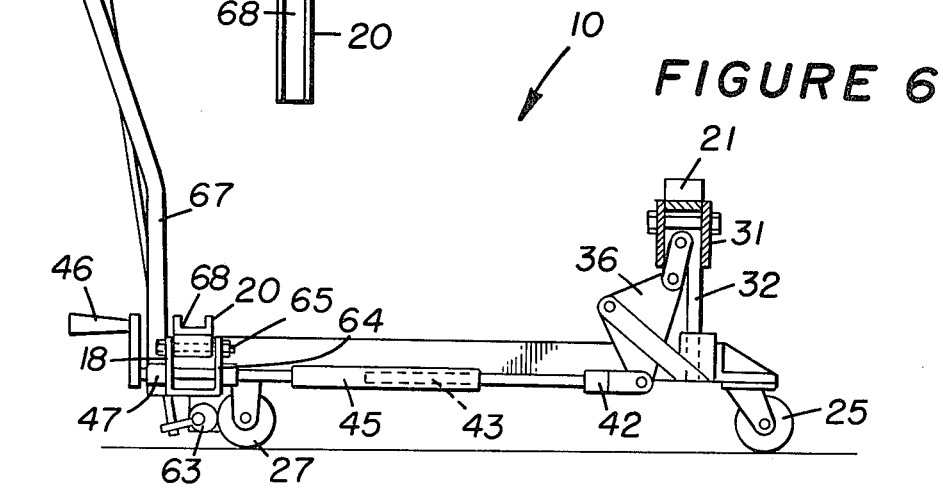
FIG. 6 is a side elevation thereof.

As further illustrated in FIGS. 5 and 6, jack screw 43 is connected through a threaded coupling 45 to a manipulating handle 46 carried on a journal bracket 47 mounted to the front portion 18 of the caddy.

Thus, as seen in FIG. 6, rotation of handle 46 in the journal support 47 causes a rotation of coupling 45 so as to threadedly adjust the connection thereof to the jack screw 43, thereby pivoting the crank arm 36 suitably to raise or lower the support 21 as a function of the direction of turning of handle 46. Thus, illustratively, to raise the connecting portion 17 of the plow frame for connection thereof to the attachment portion 12 of the vehicle mounting structure, the operator merely rotates the handle 46 suitably to raise the support 21 after positioning the frame portion 17 subjacent the connecting portion 12 by suitable wheeled movement of the carried plow on the caddy generally to the position of FIG. 1. It should also be understood that an appropriate hydraulic means could be used in place of the manual handle operation to raise support 21. As shown in FIG. 1, the frame portion 17 may be secured to the vehicle attachment portion 12 by a suitable connecting pin 48. Further, as shown in FIG. 1, frame 16 may be provided with a suitable clevis 49 for connection thereto of a supporting chain 50 carried on a suitable arm 51 of the vehicle attachment means 12. As shown in FIG. 1, arm 51 is pivotally mounted to a support 52 by a pivot 53 and is swung on pivot 53 by suitable extensible device, such as hydraulic piston device 54.

It is desirable at times to lock the caddy against movement. For this purpose, a braking device generally designated 55 is provided. As shown in FIG. 2, a manipulating handle 56 is secured to the front portion 18 of the caddy and braking device 55 includes an operating handle 57 pivotally mounted to the manipulating handle by a suitable pivot 58. A connecting rod 59 is connected to handle 57 to extend downwardly therefrom to an arm 60 fixed to a cross rod 61 journaled in the mounting brackets 29 and 30 of the wheels 26 and 27. As best seen in FIG. 3, the cross rod is provided with a pair of braking bosses or shoes 62 and 63 adapted to be urged against the wheels 26 and 27, respectively, when lever 57 is pivoted downwardly, as shown in FIG. 6. When it is desired to release the wheels 26 and 27 for wheeled movement of the caddy, the operator need merely pivot the handle 57 upwardly thereby removing bosses 62 and 63 from engagement with the wheels 26 and 27. As shown in FIG. 6, the lower portion 67 of handle 56 is adjacent and extends perpendicular to the base 68 of the upwardly opening channel. Thus, the handle 56 acts as a guide when positioning the blade 14 into the upwardly opening channel by preventing the blade 14 from passing past the channel.

As indicated above, use of caddy 10 permits the attachment and removal of the plow relative to the vehicle as a one-man operation. The plow may be stored on the caddy when not in use and when it is desired to attach the plow to the vehicle, the operator may wheel the caddy with the plow carried thereon into the desired position, with the connecting portion 17 adjacent the attachment portion 12 of the vehicle, as illustrated in FIG. 1. In effecting such movement, the operator utilizes the handle 56 so as to back the plow frame into the desired position.

With the connecting portion 17 disposed subjacent the attaching portion 12 of the vehicle, the operator may lock the caddy by suitable manipulation of braking handle 57 and then raise the support 21 by suitable manipulation of jack handle 46, all of these operations being conducted at the front of the caddy. In effecting the connection, limited rocking movement of the blade 14 on channel 20 may be effected by virtue of the pivotal mounting of channel 20 to a U-bracket portion 64 of the caddy front portion 18 by a pivot 65, as illustrated in FIGS. 2 and 6.

When the connecting portion 17 of the plow frame is aligned properly with the attachment portion 12 of the vehicle plow mounting means, pins 48 may be suitably inserted to effect the pivotal connection of the plow to the vehicle. As indicated above, chain 50 may then be connected to arm 51 by insertion through slot 60 for suitably controlling the raising and lowering of the plow blade by the operator in the plowing operation through control of the hydraulic cylinder 54.

Further, the raising of the blade 14 a sufficient distance by chain 50 removes the lower edge 15 of blade 14 from the supporting channel 20 and also removes the plow frame 24 from support 21, thereby disengaging the caddy from the plow, permitting the caddy to be removed and stored as desired.

When it is desired to replace the plow on the caddy upon removal thereof from the vehicle, the caddy is merely brought into position with the channel 20 disposed under the plow edge 15 and the channel 21 under the frame portion 16. Channel support 21 is then raised into engagement with the frame portion 16 by suitable manipulation of handle 46 and the plow is lowered to dispose the lower edge portion 15 thereof in the channel 20 by suitable manipulation of the cylinder means 54. Disconnection of chain 50 from slot 60 and removal of pins 48 are then effected to disconnect the plow from the vehicle. Support 21 is then lowered by suitable reverse manipulation of handle 46 to fully separate the rear portion 17 of the plow frame from the vehicle, permitting the plow to be transported on the caddy from the vehicle as desired.

As all adjusting operations of the caddy are effected from the front portion thereof, facilitate attachment and removal of the plow relative to the vehicle may be effected. The structure of the improved caddy is extremely simple and economical while yet providing the improved functioning.

The foregoing disclosure of specific embodiments is illustrative of the broad inventive concepts comprehended by the invention.

I claim:

1. Apparatus for facilitating attachment of a plow, having a blade and a connecting frame provided with a rear connecting portion, to a vehicle having an elevated attachment portion, said apparatus comprising:

a wheeled support having a front portion and a rear portion;

a positioning handle at said wheeled support front portion for positioning the wheeled support to dispose the carried plow frame connecting portion adjacent the vehicle attachment portion;

locking means for selectively locking said wheeled support against rolling movement including a manipulating handle movably mounted to said positioning handle;

carrying means on said wheeled support front portion for removably carrying a plow blade; and adjustable means on said support under said rear portion for adjustably elevating the rear connecting portion of the plow frame to align said connecting portion with the vehicle attachment portion to provide for facilitated interconnection thereof.

2. The apparatus of claim 1 wherein said adjustable means includes an upwardly opening channel on said wheeled support rear portion for removably receiving the rear connecting portion of the plow frame and manually operating means including a manipulating handle adjacent said carrying means for adjusting the elevation of said channel, said manipulating handle of the manually operable means being disposed subjacent said positioning handle.

* * * * *